United States Patent [19]

Compagnon

[11] Patent Number: 4,781,335

[45] Date of Patent: Nov. 1, 1988

[54] WINDING MACHINE

[75] Inventor: Michel F. Compagnon, La Tour-de-Peilz, Switzerland

[73] Assignee: Maillefer SA, Switzerland

[21] Appl. No.: 91,411

[22] Filed: Aug. 31, 1987

[30] Foreign Application Priority Data

Sep. 2, 1986 [CH] Switzerland ..... 3522/86

[51] Int. Cl.[4] ..... B65H 75/00

[52] U.S. Cl. ..... 242/54 R; 242/158 R

[58] Field of Search ..... 242/54 R, 58.6, 79, 242/80, 68.7, 78.7, 66, 65, 25 A, 35.5 A, 35.5 T, 158 R, 86.8

[56] References Cited

U.S. PATENT DOCUMENTS

| | | | |
|---|---|---|---|
| 1,827,802 | 10/1931 | Sieg . | |
| 1,869,545 | 8/1932 | Crafts . | |
| 2,679,987 | 6/1954 | Saliba | 242/66 |
| 3,073,539 | 1/1963 | Brown . | |
| 3,103,322 | 9/1963 | Garner | 242/68.7 |
| 3,198,449 | 8/1965 | Scher | 242/54 R |
| 3,625,445 | 12/1971 | Hall | 242/86.5 R |
| 3,687,385 | 8/1972 | Skalleberg | 242/54 R |
| 3,948,462 | 4/1976 | Maillefer | 242/158 R |
| 4,085,904 | 4/1978 | McElroy | 242/54 R |
| 4,139,166 | 2/1979 | Powell et al. | 242/66 |

FOREIGN PATENT DOCUMENTS

| | | | |
|---|---|---|---|
| 0214091 | 7/1986 | European Pat. Off. . | |
| 3239128 | 4/1984 | Fed. Rep. of Germany | 242/54 R |
| 1538865 | 7/1968 | France . | |
| 2404593 | 6/1979 | France | 242/54 R |
| 60-242155 | 12/1985 | Japan . | |
| 0817835 | 4/1981 | U.S.S.R. | 242/54 R |
| 2158808 | 11/1985 | United Kingdom | 242/54 R |

*Primary Examiner*—John M. Jillions

*Attorney, Agent, or Firm*—Parkhurst & Oliff

[57] ABSTRACT

A carriage (2) sliding vertically on a fixed column (1) bears a driving assembly comprising a motor (3), a transmission (15, 16, 17), a shaft (18), and a rubber-covered pulley (4). A frame (10) supported by castors (11) rotates about the column. In operating position, the frame holds a working drum (5) resting on two parallel rollers (13) opposite the driving pulley. A full or empty drum is situated next to the working drum. A traverse mechanism (6, 7, 27) is borne by the column and by an auxiliary upright (8).

7 Claims, 4 Drawing Sheets

WINDING MACHINE

This invention relates to winding machines, and more particularly to a machine for winding cable on a large-diameter drum provided with two circular flanges.

Gantry-type winding machines intended for large-size drums to hold cable are usually provided with two uprights along which carriages bearing trunnions for supporting the drums slide vertically. These trunnions fit into recesses aligned with the axis of the drum so that these large objects can be driven rotatingly.

For driving drums in this manner, rotary means are often provided for causing one of the pivoting trunnions to turn, the trunnion being equipped with an off-center element coupled to one of the flanges of the drum. However, it has also been proposed to drive a reel on which wire or cable is wound by means of a roller, preferably provided with a rubber casing and pressing against the periphery of one of the flanges of the reel.

U.S. Pat. No. 1,869,545 describes a mechanism in which a web roll of paper is supported by parallel rollers which brake it so as to keep the web roll under tension.

Starting from this prior art, it is an object of this invention to provide an improved winding machine for large-size drums by simplifying and facilitating the use of such installations.

To this end, the winding machine according to the present invention comprises, on the one hand, a support frame disposed horizontally and provided with at least one pair of parallel elongated rollers capable of supporting the drum by the circular periphery of the flanges, and on the other hand, a driving roller, means for supporting this roller, and drive means, these means being arranged to allow the driving roller to be brought into contact with a point on the aforementioned circular periphery of a flange of the drum and cause the latter to rotate by friction.

A preferred embodiment of the invention will now be described in detail with reference to the accompanying drawings, in which.

Figure 1:
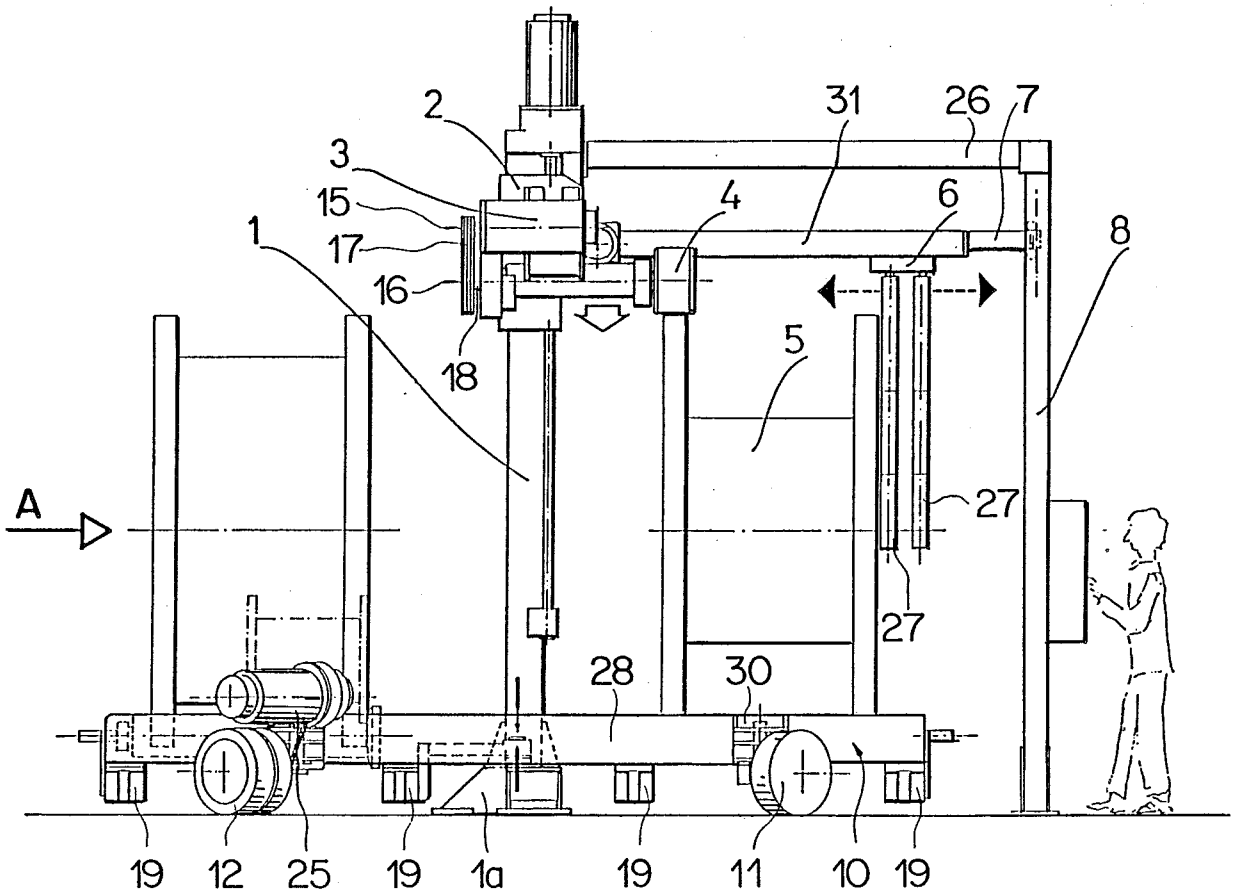
FIG. 1 is an elevation of this embodiment.

The main elements of the winding machine are a fixed column 1 of rectangular cross-section mounted on a base 1a and a frame 10 supported horizontally by four castors 11. Frame 10 is composed of two parallel longitudinal beams 28 and four crossbeams 19 fixed perpendicular to the longitudinal beams. Castors 11 have horizontal axes so oriented that the only possible movement frame 10 can make is a rotary motion about its central axis. As may be seen by comparing FIGS. 1 and 2, this central axis is close to fixed column 1. Mounted on this column is a carriage 2 which can move vertically along the column and which supports drive means made up of a motor 3, a transmission system comprising pulleys 15 and 16, and a belt 17 driving a horizontal shaft 18, at the end of which a rubber-coated pulley 4 is mounted. By means of this pulley, one of the two drums 5 mounted in frame 10 is caused to rotate. For this purpose, crossbeams 19 each bear two carriages 20 equipped with an end bearing so as to bear two pairs of rollers 13, parallel by two's and mounted on the crossbeams 19. Carriages

Figure 3:
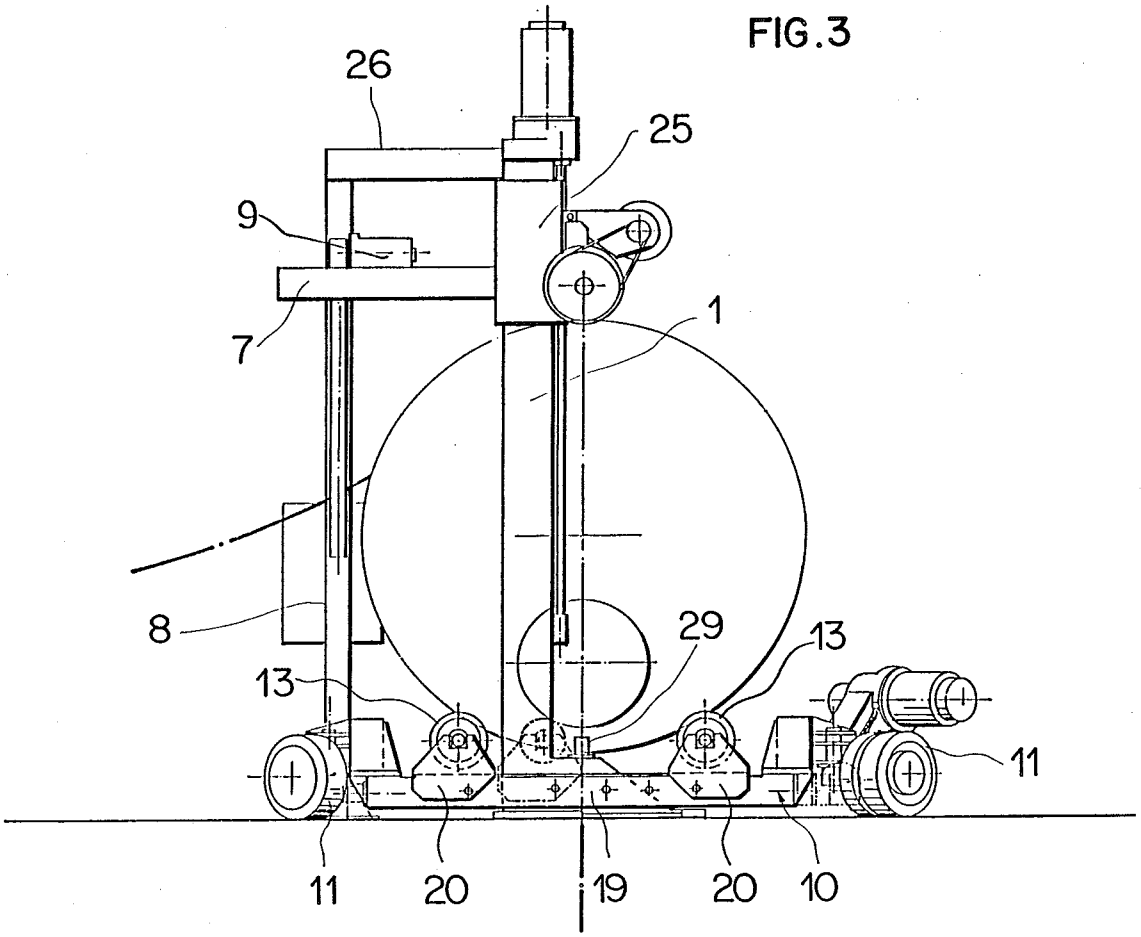
FIG. 3 is a side elevation in the direction of arrow A in FIG. 1.
Figure 4:
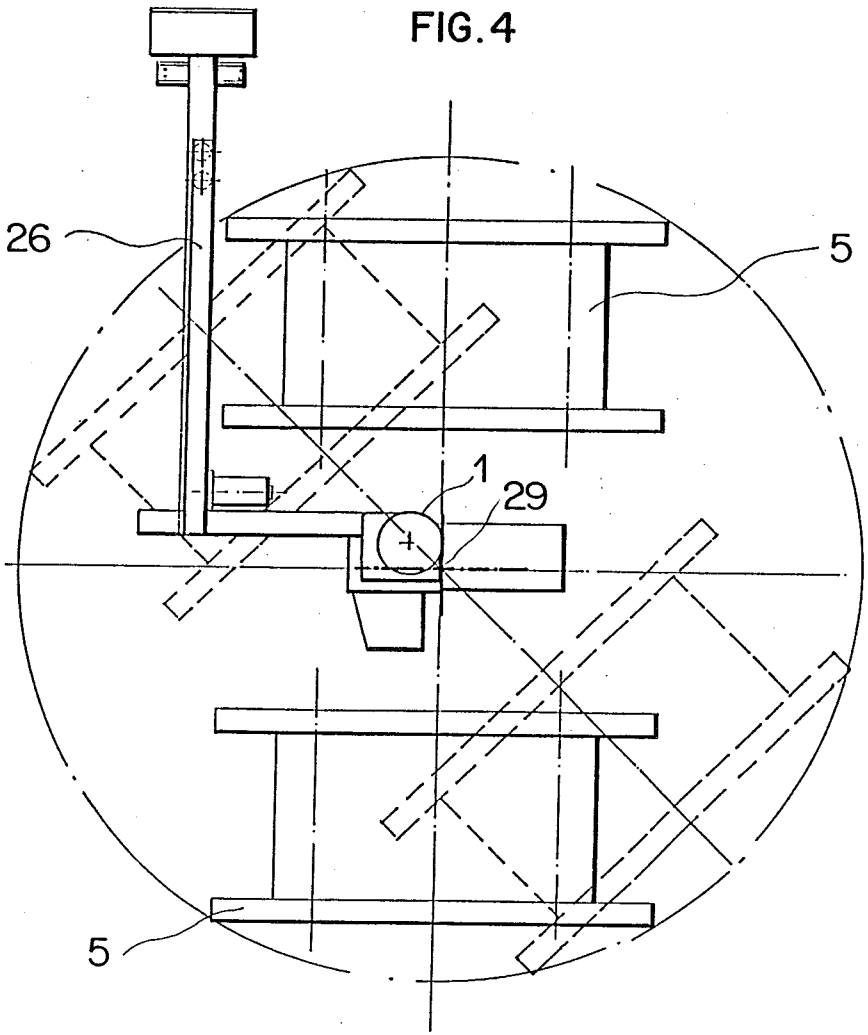
FIG. 4 is a diagrammatic top plan view illustrating the operation of the winding machine.

20 (FIG. 3) can be moved along crossbeams 19 so that the spacing between the rollers 13 of each pair can be modified at will. This makes it possible to support drums 5 of different diameters on the rollers 13. FIG. 3 shows in dot-dash lines a roller 13 placed as close as possible to the middle axis of the apparatus and the diameter of the flange of the respective drum 5. The rollers spaced as shown in solid lines correspond to the maximum diameter of the drums. In a typical embodiment, drums having flange diameters between 900 mm and 2,800 mm can be wound.

Rollers 13 include at one end one or two circular collars 21 for locating the drum by one of its flanges.

Each roller 13 is made up of three coaxial sections 22, 23, 24 having the same diameter, mounted on a common shaft, making it possible to compensate for variations in diameter of the drum flanges. With frame 10 as designed, two drums of the same or different diameters can be supported, disposed in tandem with their flanges parallel.

Figure 2:
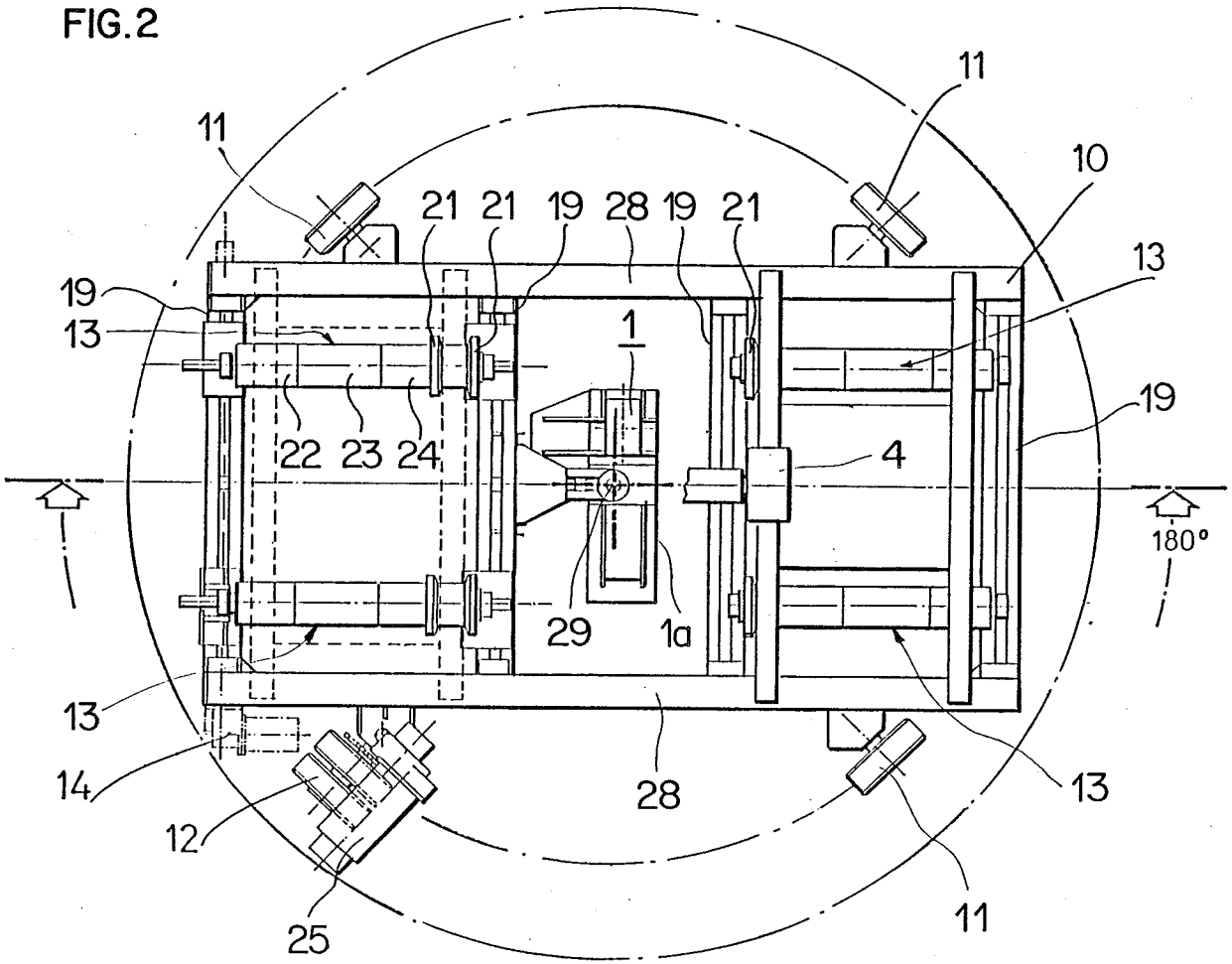
FIG. 2 is a partial top plan view.

The four castors 11 which support frame 10 are positioned at 90° to one another and turn on their horizontal axes in such a way that the only possible movement of frame 10 is a rotary movement about an axis 29 which coincides with the center of the circle defined by the points of contact between castors 11 and the floor. The bearing blocks 30 of castors 11 are fixed to longitudinal beams 28. One of them is furthermore equipped with a motor 25 which rotates an auxiliary roller 12 by means of which frame 10 can be turned. As stated above, the axis of rotation of frame 10 is situated near column 1, so that if two drums are mounted on frame 10, they describe circular paths about column 1. For the position in which frame 10 is shown in FIGS. 1–3, driving pulley 4 rotates one of the drums 5 mounted on the two rollers 13 situated at the right in FIG. 2, while the rollers 13 situated on the opposite side of frame 10 are ready for the unloading of a full drum and the placing of an empty drum.

For winding, column 1 supports one end of a cable-guide base 7, the other end of which is supported by an auxiliary upright 8 connected to column 1 by a rigid structure 26. Cable-guide base 7 can be adjusted in height. Moreover, it bears a guide-rail 31 for a carriage 6 suspended from this arm and in turn bearing two parallel candles 27 disposed vertically. These two candles may in turn be displaced on carriage 6 so that their spacing can be adjusted as a function of the diameter of the cable. As in any traverse mechanism, carriage 6 is controlled by drive means so as to be able to reciprocate on base 7 and consequently regulate the laying-down of the cable on drum 5 being rotated by pulley 4.

Motor 3 for driving pulley 4 is a variable-speed DC motor, as is motor 9 (FIG. 3) which displaces cable-guide carriage 6. In the embodiment described above, a three-phase motor 14 is also provided for controlling the spacing of rollers 13.

Although the embodiment described above comprises a fixed central column 1 and a rotating frame 10 with rollers 13 capable of supporting two drums simultaneously, the principle of the winding machine according to the present invention can equally well be carried out in other embodiments. Several independent carriages, each bearing a drum, might be provided to cooperate with central column 1. These carriages might execute both a rotary and a translatory motion. In all these embodiments, an important advantage of the invention is to be found: while one drum is filling up, the full drum is in a position readily accessible by means of a travelling crane or a fork-lift truck. Thus, the full drum can be removed and replaced by an empty one. The drum need no longer be held between trunnions, which would require complicated movements carried out by means of rotary parts. In this respect, too, the invention represents a simplification.

I claim:

1. A machine for winding cable on a large-diameter drum provided with two flanges, each having a circular periphery, comprising:

a support frame disposed horizontally and including at least one pair of elongated, parallel rollers capable of supporting the drum by the circular peripheries of the flanges thereof;

drive means;

a drum-driving pulley driven by said drive means;

means for supporting said pulley and for bringing said pulley into contact with a point on the circular periphery of a flange of the drum for causing the drum to rotate by friction;

said frame including a plurality of pairs of said rollers for receiving a plurality of drums and displacement means for bringing the drums successively into a driving position in contact with said pulley, and a fixed column and a carriage slidable along said column, said frame being horizontally movable, and said drive means and said means for supporting said pulley being mounted on said carriage.

2. The winding machine of claim 1, further comprising a fixed auxiliary upright and horizontal cable-guide base having one end supported by said column and another end resting upon said support; and wherein said frame is mounted on casters for rotation about a fixed axis situated near said column.

3. The winding machine of claim 1, further comprising displaceable bearings disposed on said frame for supporting said rollers and for adjusting the spacing thereof.

4. The winding machine of claim 3, wherein each of said rollers is divided into coaxial, independently rotating segments to compensate for irregularities in the diameters of the drum flanges.

5. The winding machine of claim 1, further comprising a fixed auxiliary upright and a horizontal cable-guide base having one end supported by said column and another end resting upon said upright.

6. The winding machine of claim 5, further comprising a cable-guide carriage movable on said cable-guide base and two adjustably spaced, parallel candles suspended from said cable-guide carriage, said candles being displaceable in a direction parallel to said rollers supporting the rotatingly driven drum.

7. The winding machine of claim 1, wherein said frame is mounted on castors for rotation about a fixed axis situated near said column.

* * * * *